US007782169B2

(12) United States Patent
Guenther

(10) Patent No.: US 7,782,169 B2
(45) Date of Patent: Aug. 24, 2010

(54) MAGNETIC CORE

(75) Inventor: Wulf Guenther, Maintal (DE)

(73) Assignee: Vacuumschmelze GmbH & Co. KG, Hanau (DE)

( * ) Notice: Subject to any disclaimer, the term of this patent is extended or adjusted under 35 U.S.C. 154(b) by 253 days.

(21) Appl. No.: 11/863,956

(22) Filed: Sep. 28, 2007

(65) Prior Publication Data

US 2008/0074220 A1 Mar. 27, 2008

Related U.S. Application Data

(63) Continuation of application No. PCT/EP2006/002152, filed on Mar. 9, 2006.

(30) Foreign Application Priority Data

Apr. 1, 2005 (DE) ..... 10 2005 015 006

(51) Int. Cl.
*H01F 27/24* (2006.01)

(52) U.S. Cl. ..... 336/234

(58) Field of Classification Search ..... 336/212, 336/233–234, 178
See application file for complete search history.

(56) References Cited

U.S. PATENT DOCUMENTS

| | | | | |
|---|---|---|---|---|
| 3,031,736 | A | 5/1962 | Madden | 29/155.5 |
| 3,543,249 | A | 11/1970 | Bobeck et al. | 340/174 |
| 3,938,018 | A | 2/1976 | Dahl | 320/2 |
| 4,506,248 | A * | 3/1985 | Lin | 336/233 |
| 4,800,328 | A | 1/1989 | Bolger et al. | 320/2 |
| 2002/0057169 | A1 | 5/2002 | Alback et al. | 336/198 |
| 2003/0005570 | A1 | 1/2003 | Weber | 29/602.1 |
| 2003/0117282 | A1 | 6/2003 | Copeland et al. | 340/572.7 |
| 2004/0201535 | A1 | 10/2004 | Sano | 343/788 |
| 2006/0022886 | A1 | 2/2006 | Hein et al. | 343/787 |

FOREIGN PATENT DOCUMENTS

| | | |
|---|---|---|
| CH | 265957 | 4/1950 |
| DE | 475064 | 4/1929 |
| DE | 1804835 | 10/1968 |
| DE | 19536267 | 9/1995 |
| DE | 29817865 | 10/1998 |

(Continued)

OTHER PUBLICATIONS

International Search Report; PCT/EP2006/002152; pp. 11, Mar. 9, 2006.

*Primary Examiner*—Tuyen Nguyen
(74) *Attorney, Agent, or Firm*—King & Spalding L.L.P.

(57) ABSTRACT

A magnetic core (1, 1', 20, 28, 29, 58, 61, 70, 70', 80, 80', 90) for a magnetic component has a longitudinal axis parallel to which a magnetic current is to be substantially guided inside the magnetic core. The magnetic core consists of a plurality of magnetic elements (2, 3, 4, 5, 6, 7, 8, 29, 30, 35, 36, 38, 39, 40, 48, 49, 52, 53) shaped like bars or strips arranged parallel to one another, at least one of the magnetic elements (2, 3, 4, 5, 6, 7, 8, 29, 30, 35, 36, 38, 39, 40, 48, 49, 52, 53) is different from the other magnetic elements in one or several of the following characteristics: permeability of material, curvature, length, shape and/or size of surface area, presence, type and location of notches in the magnetic elements.

17 Claims, 4 Drawing Sheets

FOREIGN PATENT DOCUMENTS

| | | | |
|---|---|---|---|
| EP | 0118198 | | 2/1984 |
| EP | 0256347 | | 7/1987 |
| EP | 0367602 | | 11/1989 |
| EP | 0989569 | | 9/1999 |
| EP | 1308884 | | 7/2001 |
| EP | 1489635 | | 6/2004 |
| GB | 2361110 | | 10/2001 |
| GB | 2388715 | | 11/2003 |
| GB | 2399225 | | 9/2004 |
| GB | 2399227 | | 9/2004 |
| JP | 56157013 | A * | 12/1981 |
| WO | 03/096361 | | 11/2003 |
| WO | 2004/066438 | | 8/2004 |

* cited by examiner

FIG 8a
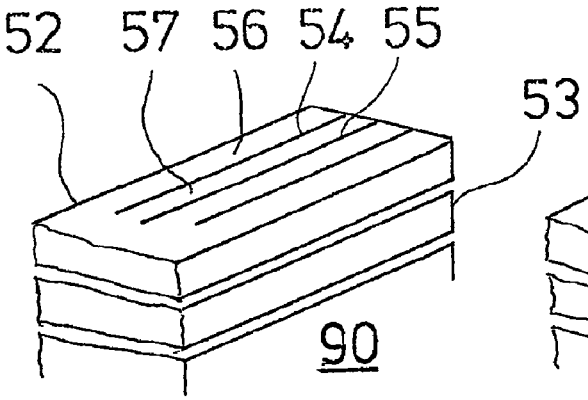
FIG 8b
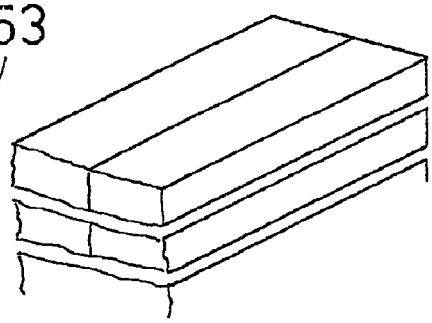
FIG 9
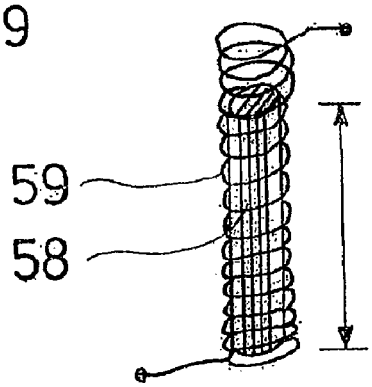
FIG 10a
FIG 10b
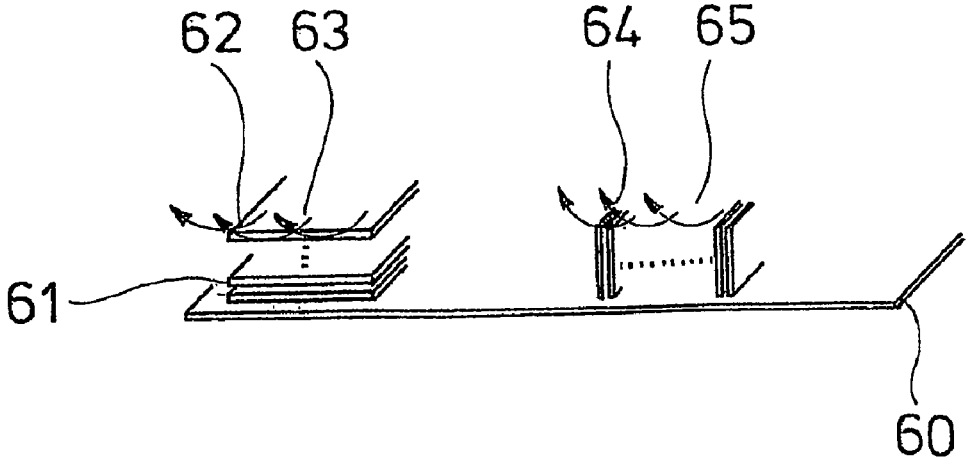

MAGNETIC CORE

CROSS-REFERENCE TO RELATED APPLICATION

This application is a continuation of co-pending International Application No. PCT/EP2006/002152 filed Mar. 9, 2006, which designates the United States, and claims priority to German application number 10 2005 015 006.3 filed Apr. 1, 2005, the contents of which are incorporated herein by reference in its entirety.

TECHNICAL FIELD

The present invention relates to magnetic cores for inductive components.

BACKGROUND

Magnetic cores are required for many high-performance inductive components, for example, for transformers, electric motors, electromagnets, and antennas. Magnetic cores made of soft-magnetic materials are used for the purpose of bundling and orienting the magnetic flux and thus effectively guiding it.

A special construction and also the subject matter of the present invention are cores having an air gap in which the magnetic flux thus leaves the magnetic material at least once within the magnetic circuit. In slotted ring band, oval band, and rectangular cores, inter alia, the air gap is small in relation to the so-called iron path length located in the magnetic material, correspondingly, the magnetic path in the magnetic material and thus the core must be curved.

In rod cores, the magnetic core is elongate, the magnetic flux exits at least partially from the rod ends and is returned through the surroundings, the path length in the nonmagnetic material (e.g., air) is longer than in the magnetic material here. In addition, further mixed forms are known (e.g., U-shaped cores). In all of these shapes, the flux not only exits at the core ends (facing toward the air gap), but rather also on the sides. In the implementation of the core made of elongate sheet or fibrous elements observed here, flux thus exits not only from the front sides of the elements, but rather also from the side faces, which results in additional problems in comparison to the known solid, isotropic magnetic materials.

The present invention thus relates to all open magnetic cores (the magnetic flux exits at least once from the magnetic material) made of laminated magnetic elements. For reasons of simple illustration and greatest relevance, rod cores are considered above all in the following. The statements may be transferred to slotted ring band cores, for example, in that the rod core is curved in such a way that the rod ends are opposite one another. Rod cores are used as an antenna core, for example. The magnetic flux is bundled more effectively both in transmission and also reception antennas by them than in air coils.

Such an effective action of a magnetic core in connection with a winding surrounding it is necessary to achieve optimized transmission or reception performance, for example. This may be necessary to transmit information, but also to transmit energy. Specifically, corresponding conductive elements are used both in theft protection, identification, and access systems for information exchange over distances of approximately 5 m, and also for conductive power transmission, for example, battery charging (compare GB 2388715 A) or for power supply of sensors or actuators (compare U.S. Pat. No. 3,938,018).

For functional optimization of an inductive element of this type, in particular optimizing the transmitted power, the design of the antenna and its activation are decisive. The maximum possible flux must be generated in the magnetic core in the area of the antenna, which has at least one magnetic core and one winding. Hysteresis losses in the core or losses in the antenna coils due to resistive power, proximity effect, etc., are to be minimized to optimize the efficiency as a result. Especially hysteresis losses would also result in intrinsic heating of the magnetic core in addition to reduction of the transmission power, which may result in damage to the winding or other components in its surroundings.

A magnetic core of this type, as is required for an antenna, is typically constructed as a rod core in the form of a cuboid, which is enclosed by one or more coils. The flux exits from the front faces in the direction of the longitudinal axis of the cuboid in greatest part, but partially also from the side faces and especially at the edges of the core ends. There is typically a flux concentration and thus overload by saturation in these areas of the corners and edges at the core ends. For this purpose, beveling the edges is known as a solution (EP 762535 B1).

For example, ferrites or soft-magnetic metals are known as a material for the magnetic core from the prior art. Materials of this type are typically homogeneous and isotropic, so that the permeability is a scalar and not a second rank tensor. This means that the flux propagates linearly in the magnetic core and corresponding to a field course expected in air. Magnetic cores made of thin layers of soft-magnetic strips, as are often used for cores having an air gap and more recently also for cores of antennas, in contrast, have properties deviating therefrom because of their anisotropy. In particular in regard to the losses due to eddy currents, in the event of a flux in the longitudinal direction of a strip of this type, a reduction of the eddy current strength results in that only a very restricted space is available perpendicular to the flux direction due to the low thickness of the strip. Eddy currents may only propagate very weakly because of this. Only the magnetic flux entering perpendicular to the flat side of a magnetic strip of this type may generate eddy currents in the plane of the strip to a significant extent.

Typical hysteresis losses may be described in metallic material in the frequency range to be observed here, which is between 15 and 150 kHz, for example, by the formula $P \sim B^2 f^2 d^2$. (B=induction amplitude, f=frequency, d=spatial dimension, i.e., the smallest diameter of the eddy current path). The analysis of this formula results in the insight that on one hand the induction amplitude must be distributed as uniformly as possible over the core cross-section and on the other hand the dimension of individual magnetic elements perpendicular to the flux course must be as small as possible.

Therefore, to optimize the magnetic core exploitation, it is to be ensured that the largest possible part of the magnetic flux actually propagates within the magnetic core in the longitudinal direction of the strips or also corresponding rod-shaped magnetic elements. This is counteracted by the effect that in the above-mentioned typical cuboid core shape, the magnetic flux does not run parallel to the antenna axis everywhere. For example, in a typical dipole field, flux lines also enter in the lateral faces of a magnetic core, which correspondingly have components perpendicular to a magnetic element in the form of a magnetic strip or a magnetic rod and/or its longitudinal axis and accordingly generate higher losses.

It initially has a positive effect that the magnetic flux predominantly stays inside the core in a single magnetic element due to the implementation of air gaps or insulation layers between the individual magnetic elements, which is fundamentally desired. However, due to this effect, because of the flux lines entering in the lateral faces of the magnetic core, an increased flux accumulates in the outermost layers of magnetic elements, which may result in overload due to saturation there. Because the hysteresis losses are a function of the square of the induction amplitude and are thus not linear, an avoidable increase of the loss rate results through such an uneven flux distribution over the cross-section of the magnetic core. A further object thus results of distributing the magnetic flux as uniformly as possible over the cross-section of the magnetic core.

This is desirable in particular if an asymmetrical form of the magnetic flux arises due to the presence of magnetically active parts in the surroundings of the magnetic core, such as metal sheets, which may displace the magnetic flux, or soft-magnetic materials, which attract the magnetic flux. An asymmetrical form of this type inside and outside the core is also to be taken into consideration by a corresponding design of the magnetic core.

In ferrites, on one hand such anisotropy effects do not result because of the isotropy of the material, on the other hand hysteresis losses due to eddy currents are not especially pronounced at all because of the high specific ohmic resistance.

SUMMARY

In consideration of the statements above, according to an embodiment, a magnetic core which is especially high-performance in regard to avoiding any current losses and/or hysteresis losses and is designed for uniform distribution of the flux to avoid saturation effects, is made of metallic alloy having a linear or curved longitudinal axis, parallel to which a magnetic flux is to be guided essentially inside the magnetic core, the magnetic core being assembled from multiple rod-shaped or strip-shaped magnetic elements implemented parallel to one another, wherein at least one of the magnetic elements differs from the others in one or more of the following features: material permeability, curvature, length, shape and/or size of the cross-sectional area, presence, type, and position of notches in the magnetic elements.

According to another embodiment, multiple of the magnetic elements may differ from other magnetic elements in regard to one of the cited features as a function of their position within the magnetic core. According to another embodiment, the multiple magnetic elements can be symmetrically distributed among the other magnetic elements in regard to the cross-section of the magnetic core in relation to a central axis or a central plane. According to another embodiment, viewed from the longitudinal axis running in the center of the magnetic core outward toward at least one side, the magnetic elements may have, with increasing distance a decreasing material permeability and/or a decreasing length and/or an increasing curvature away from the longitudinal axis and/or a thickness which becomes smaller and/or an increasing number and/or growing depth of notches. According to another embodiment, the magnetic core is constructed mirror symmetric in relation to a central plane which contains the longitudinal axis. According to another embodiment, the magnetic core can be constructed radially symmetric in relation to its longitudinal axis. According to another embodiment, the magnetic elements laid on one or more lateral faces of the magnetic core may differ from the other magnetic elements in regard to at least one of the cited features. According to another embodiment, a continuous or step-by-step transition in regard to the extent of the differences in relation to one of the cited features can be provided between the magnetic elements laid on the lateral faces of the magnetic core and the longitudinal axis of the magnetic core. According to another embodiment, the magnetic elements laid directly on a lateral face of the magnetic core can be curved away at their ends from the longitudinal axis of the magnetic core. According to another embodiment, the magnetic elements can be implemented as strip-shaped, and at least the outer magnetic elements of the magnetic core have one or more notches, which run parallel to one another and completely penetrate the particular magnetic element, and which extend from the end of the particular magnetic element therein and divide it in width. According to another embodiment, the magnetic elements may comprise a soft-magnetic material, in particular a nanocrystalline material or a glass-like magnetic material produced by rapid solidification technology. According to another embodiment, some of the magnetic elements may have an enlarged cross-sectional area toward their ends, and in particular others of the magnetic elements have a reduced cross-sectional area toward their ends. According to another embodiment, those magnetic elements which have enlarged cross-sectional areas toward their ends can be situated in the center of the magnetic core, while magnetic elements having a cross-sectional area remaining uniform over their length or decreasing toward the ends are situated on the exterior sides of the magnetic core.

According to yet another embodiment, a configuration allows especially effective use as an inductive element for an antenna or similar component by having a magnetic core as described above, wherein the configuration further comprises an electrically conductive winding enclosing the magnetic core, wherein the turn density increases toward at least one of the ends of the magnetic core.

According to yet another embodiment, a configuration may have a magnetic core as described above, wherein the configuration further comprises an electrically conductive winding enclosing the magnetic core, wherein the winding extends axially beyond its end on at least one end of the magnetic core.

According to yet another embodiment, a configuration may have a magnetic core as described above, wherein the configuration further comprises an electrically conductive winding enclosing the magnetic core, wherein the turn density increases toward at least one end of the magnetic core and the winding extends axially beyond its end on at least one end of the magnetic core.

According to yet another embodiment, a configuration may have a magnetic core as described above, and comprise an additional magnetically active body, due to whose presence the magnetic flux enters and/or exits the magnetic core asymmetrically.

According to yet another embodiment, the body can be an electrically conductive body. According to yet another embodiment, the body may comprise a material having a magnetic permeability >1. According to yet another embodiment, the magnetic core can be implemented and situated in such a way that the magnetic flux predominantly exits at edges of the magnetic elements.

BRIEF DESCRIPTION OF THE DRAWINGS

The present invention is described in greater detail in the following on the basis of exemplary embodiments illustrated in the figures of the drawings.

FIG. 8*a* shows a magnetic core having magnetic elements which carry notches, FIG. 8*b* shows a magnetic core having magnetic elements which carry through notches, FIG. 9 shows a magnetic core having a winding which projects beyond it at one end and is gathered at the other end, FIGS. 10*a*, 10*b* show the different conditions at the flux exit from a laminated body in two orientations in relation to the asymmetrical outside which are pivoted in relation to one another.

DETAILED DESCRIPTION

Figure 1:
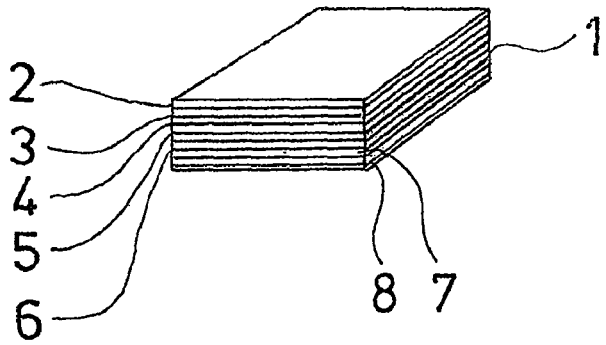
FIG. 1 shows a cuboid laminated magnetic core.

According to various embodiments, eddy current losses may both be effectively limited, and also the flux distribution on the various magnetic elements within a magnetic core may be optimized if the elements are not identical to one another, i.e., if at least one of the magnetic elements differs from the others by one or more of the following features:

- material permeability,
- curvature,
- length,
- shape and/or size of the cross-sectional area,
- presence, type, and position of notches in the magnetic elements.

Each of these features alone may already cause an improvement, however, the combination of two, three, or four of these features in a magnetic core is especially effective. The magnetic elements may be loosely joined to one another, but may also be fastened to one another by gluing. Magnetic cores and configurations according to various embodiments are suitable for a frequency range of 5 kHz to 10 MHz, in particular 15 kHz to 150 k Hz. The advantages of the present invention are also especially active in this range.

If the outer magnetic elements, in rod-shaped elements all around the external layer, in strip-shaped elements the two external strips, are provided with a lower material permeability than the remaining strips in a magnetic core, the centrally situated magnetic elements attract the entering flux due to their higher permeability. In this way, the external magnetic elements overloaded by the flux components incident diagonally in the lateral faces of the magnetic core are relieved and this results in evening out of the flux distribution overall. This design may also be altered in that the material permeability rises continuously or in steps from the outside to the inside in the individual magnetic elements.

If shorter magnetic elements are used on the outside in a magnetic core than in the central area, the flux lines entering laterally into the magnetic core are only partially incident on the outermost magnetic elements and partially on magnetic elements lying further inward, where the internal magnetic elements are longer than the external magnetic elements. This has the result that in particular the diagonally incident flux components are distributed on multiple magnetic elements and do not occur exclusively in the external magnetic elements. The flux distribution on the cross-section of the magnetic core is also evened out by this measure. Possibly occurring eddy current losses are distributed more uniformly on the cross-section, so that possibly occurring heating is also distributed uniformly over the magnetic core. Flux entering the core laterally may additionally enter the front sides of the shortened elements instead of the face of sheet-shaped elements, so that the eddy current losses may thus be lowered. The magnetic elements are advisably situated in such a way that the external shortened magnetic elements of the bundle remain back behind the ends of the centrally situated magnetic elements symmetrically on both ends. Not only may the outermost magnetic elements be shortened, but rather a continual shortening of the magnetic elements may be provided from the inside to the outside and/or from the center to one side or on both sides in strip-shaped magnetic elements.

A magnetic core is known from US 2003/0005570, which comprises strip-shaped magnetic elements which have various dimensions. However, this measure is not related therein to an improvement of the loss performance and a yoke body for a transformer is discussed therein, the magnetic elements additionally not differing in length, but rather width.

The problem that the mean flux density is highest in the core middle because of the flux entering laterally at the ends is referred to in WO 03/096361 A1 and GB 2399227 A. This is to be counteracted in that the core cross-section is enlarged by suitable folding of the core material in the middle, which also corresponds to shortening of individual strip layers as a result. Because no consideration is taken of the consequences on the flux distribution over the core cross-section and in particular the eddy currents worked out here, the suggested measures are not sufficient to adequately solve the problem on which the present invention is based. The suggested folding technology even causes further problems: to avoid eddy currents, it is required according to various embodiments that the flux enters on the front and side edges. These are buckled in the cited publications, however, i.e., the effective eddy current path is at least doubled, which results in an undesired increase of the eddy currents.

The outer of the magnetic elements (in rod-shaped magnetic elements the radially outermost layer, in strip-shaped magnetic elements the two outer layers) may also be curved away from the central longitudinal axis of the magnetic core at its ends.

This has the result that the magnetic core is adapted especially well to the typical fan-shaped flux course of a dipole field outside the magnetic core. Flux lines entering diagonally into the front side of the magnetic core are incident nearly perpendicularly on the front sides of the fan-shaped expanded magnetic elements, if they have cuboid or cylindrical shapes as usual. This has advantageous effects, as described above, on the reduction of eddy current losses and on uniform distribution of the flux density over the cross-section of the magnetic core.

The magnetic core may be designed in such a way that only the outer layer of the magnetic elements is correspondingly curved, but the individual magnetic elements may also have a curvature which becomes smaller away from the longitudinal axis from the outer layer toward the center, so that a typical fan-shaped course of the magnetic elements results in longitudinal section, either in three dimensions in rod-shaped magnetic elements or only in two dimensions in strip-shaped magnetic elements.

The magnetic elements in the outermost layer and/or at the greatest distance from the central longitudinal axis of the magnetic core may also be implemented as thinner or having smaller cross-sectional area and the central magnetic elements of the magnetic core. On one hand, only the outermost magnetic elements may differ from the others in regard to the thickness for the cross-section or also, on the other hand, a step-by-step or more or less continuous rise of the thickness of the individual magnetic elements may be provided from the outside to the inside.

In the following, some examples of combinations of features according to various embodiments are listed, without this meaning that unlisted combinations would not be advantageous.

In a magnetic core, the outer magnetic elements may have a lower material permeability than the inner elements and may simultaneously be curved outward on their ends.

In the event of a material permeability which decreases toward the outside, only the length of the magnetic elements may be reduced toward the outside. Simultaneously, the thickness of the individual magnetic elements may also be decreased toward the outside if desired.

It is also advantageous if the outer magnetic elements have an increasing curvature outward as the thickness becomes lower.

When magnetic cores according to various embodiments are assembled from the magnetic elements, for example, thin strip conductors may be kept in reserve which are provided as nanocrystalline soft-magnetic materials and also may be produced in rapid solidification technology, for example, having corresponding different features. Upon assembly, differing magnetic elements in regard to material permeability, thickness, and length are assembled. Already pre-curved magnetic elements may also be kept in reserve.

For the curvature of the ends of magnetic elements, however, after the assembly of a magnetic core, the outer magnetic elements may be fanned out at their ends by a tool and a corresponding curvature away from the longitudinal axis may thus be generated.

In particular, the cited features may also be distributed asymmetrically in a magnetic core to take corresponding ambient conditions which cause an asymmetrical flux distribution into consideration.

For example, one half of a magnetic core may be constructed homogeneously in regard to all features, while the other half is designed inhomogeneously according to various embodiments.

The reduction of the effective strip width in areas in which flux components enter into the strip layers perpendicularly has a further advantage. For these components, the strip thickness is not decisive for the hysteresis losses, but rather the width, which must also be used for the strip width in the formula specified above for the losses. The interruption of the eddy current paths, i.e., in the simplest case notching of the strip layers parallel to the strip longitudinal axis, suffices for the desired effect. Notching precisely along the field lines, i.e., diagonally away from the strip central axis, is more ideal but technically more difficult.

It follows from the loss formula that the reduction of the losses is especially effective if the resulting strip width is small, e.g., in the magnitude of 0.3-2 mm, which may be technically implemented. A noticeable reduction is already achieved, however, if a 12 mm wide strip is cut into thirds, for example. The improvement potential increases with rising frequency: at 10 kHz, for example, less utility is achieved with identical subdivision than at 1 MHz, for example.

This method provides the greatest improvement in areas having significant flux components perpendicular to the strip base, i.e., at the strip ends of the outermost strip layers. Notching only a few outer or even only the outermost strip layers from the ends thus suffices. However, it may be technologically more favorable to cut all strip layers and/or the entire length. No disadvantage thus arises.

The subdivision may also be performed by sawing, etching, eroding, etc. in addition to notching. This measure may be combined arbitrarily with all other cited measures, of course.

If an inductive element is constructed having the magnetic core according to various embodiments and a coil in the form of a winding, the effect according to various embodiments may be amplified in that the winding density increases toward at least one of the ends of the magnetic core and/or the winding extends beyond one of the ends of the magnetic core. Due to each of these measures, the flux penetrating the magnetic core is bundled at the end of the magnetic core and oriented in the longitudinal direction, so that the component of flux lines entering or exiting diagonally through the lateral faces of the magnetic core is reduced. If the magnetic core extends beyond a winding, especially many flux lines exit or enter diagonally through the lateral faces of the magnetic core in particular at the end of a winding. This may be prevented in a targeted way by the cited features.

In a configuration having a magnetic core according to various embodiments and other magnetically active parts, which asymmetrically alter the distribution of the magnetic flux in the surrounding area of the magnetic core, an asymmetrical variant of the magnetic core is advantageously designed and situated in relation to the asymmetrical magnetic field in such a way that on one hand the entry of flux lines through lateral delimitation faces of the magnetic core is minimized and on the other hand the distribution of the flux on the cross-section of the magnetic core is evened out as much as possible overall. This is the case, for example, in configurations where a transmission and a reception antenna are opposite one another at a small distance to transmit power over an air gap to charge a battery, for example. The resulting magnetic field course is highly asymmetrical and this fact may be taken into consideration by the described design.

In the case of a strongly asymmetrical field design, a magnetic core comprising strip-shaped magnetic elements may also be situated in such a way that the flux lines entering diagonally on one side of the magnetic core into its lateral faces are incident on the narrow sides of the corresponding strip-shaped magnetic elements. For this purpose, the magnetic core only has to be oriented in such a way that the interfaces between the strip-shaped magnetic elements are oriented parallel to the incident flat lines.

The eddy currents caused in the magnetic elements only have a very small diameter in this entry direction because of the low thickness of the magnetic elements (compare above-mentioned formula, d corresponds to the thickness of the strips) and eddy current losses are thus effectively limited.

In addition to this design of the configuration, of course, the features according to the described embodiments may also be fulfilled individually or jointly if desired.

In addition, alone or in connection with the features listed according to an embodiment, the individual magnetic elements of a magnetic core may have a cross-section varying over their length. In particular strip-shaped magnetic elements may become thicker toward their ends.

The thickened ends thus act as a type of pole shoe, through which flux lines enter increasingly into the particular magnetic elements. Magnetic elements thickened at the ends in this way may particularly be situated in the internal area of a magnetic core, to capture especially many flux lines in this area and thus even out the flux density, because the magnetic elements, as described above, additionally capture the diagonally entering flux lines in the outer area.

In this context, the external magnetic elements may also be thinned at their ends, so that overall a cuboid cross-section of the magnetic core results.

The thickening of individual magnetic elements described may particularly be provided without problems in the event of fanning of the ends, if they are curved away from the longitudinal axis of the magnetic core.

FIG. 1 shows a magnetic core 1, which is produced as a laminate from multiple rectangular, equally large, strip-shaped magnetic elements 2 through 8, which are connected with thin plastic layers interposed using adhesive, for example.

The individual magnetic elements 2 through 8 may comprise an amorphous or nanocrystalline metallic material having soft-magnetic properties, for example, from which high-performance magnets may be produced.

Magnetic cores of this type may be used to form inductive components employing a winding surrounding these cores, for example. High-performance magnetic cores of this type may be used in particular as a component of an antenna for information transmission or for transmitting power.

Figure 2A:
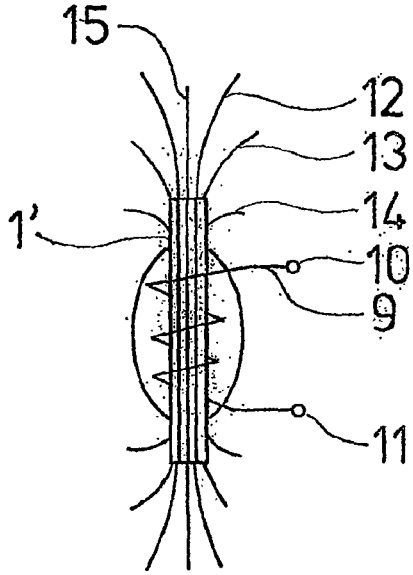
FIG. 2*a* shows a laminated magnetic core having a winding and the field surrounding it.

In this regard, FIG. 2*a* schematically shows a simple construction having a magnetic core 1', which is enclosed by a winding 9 having the two terminals 10, 11. In addition, the flux lines 12, 13, 14 are shown, which correspond to the course of a normal magnetic dipole field. In addition, the longitudinal axis 15 of the magnetic core is plotted.

Figure 2B:
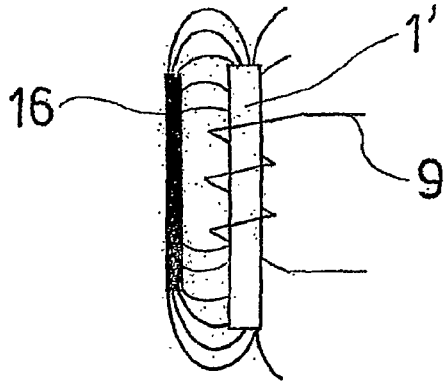
FIG. 2*b* shows the field distribution around a magnetic core having a neighboring soft-magnetic body.

The same magnetic core 1' is shown in FIG. 2*b*, the laminated construction not being shown separately, and, in addition to the magnetic core, a further soft-magnetic body 16 having higher permeability being shown on its left side, which attracts the magnetic flux. Thus, when one observes the course of the flux lines, an asymmetrical field course results, which is shown in FIG. 2*b*. More flux lines lead from the magnetic core 1' to the left side than to the right side, because the magnetic circuit is essentially closed left of the magnetic core 1' via the magnetic air gap and the soft-magnetic body.

Figure 2C:
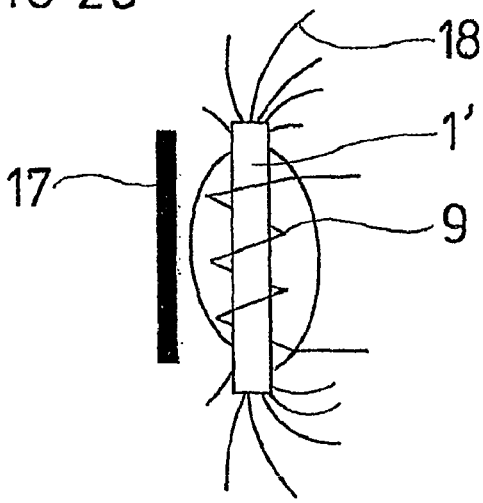
FIG. 2*c* shows a magnetic distribution around a magnetic core having a neighboring non-magnetic metallic body.

FIG. 2*c* shows the magnetic core 1' in a configuration having a non-magnetic metal plate 17, which displaces the magnetic flux because of the eddy currents induced in the metallic body, which counteract the magnetic field. Correspondingly, the flux lines 18 preferably close via the right side of the magnetic core 1' via the air gap.

In the cases shown in FIGS. 2*b* and 2*c*, there is an asymmetrical distribution of the flux lines in the area of the magnetic core 1. This also fundamentally has the result in a laminated construction magnetic core that the individual magnetic elements guide the flux at varying intensity. The effectiveness may be increased here by rotating the magnetic core analogously to FIG. 10*b* in such a way that the strip layers run parallel to the plane of the drawing.

Figure 2D:
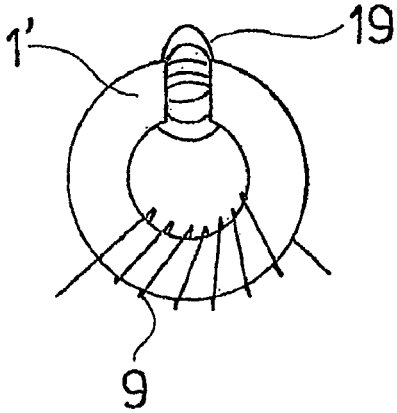
FIG. 2*d* shows the magnetic distribution around an annular magnetic core having a gap.

FIG. 2*d* shows the magnetic core 1' in an annular design having a gap in whose proximity flux lines 19 exit from the core material.

Figure 3A:
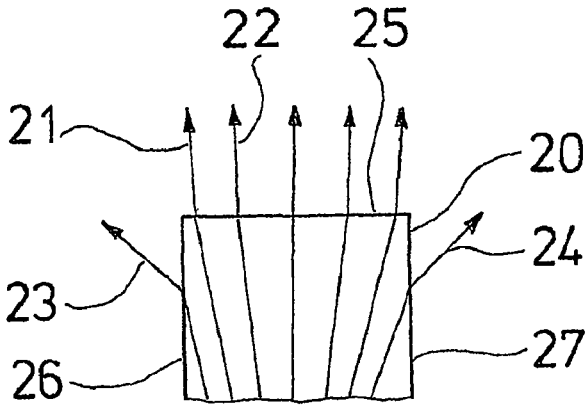
FIG. 3*a* shows the flux course at the edge of an isotropic magnetic core, e.g., ferrite.

FIG. 3*a* schematically shows the exit of flux lines 21, 22, 23, and 24 in a solidly constructed magnetic core 20, e.g., a ferrite core. As may be seen clearly, most flux lines 21, 22 exit through the front face 25 of the magnetic core 20. Because of the typical field distribution shown in FIGS. 2*a*, 2*b*, 2*c*, however, some of the flux lines 23, 24 also exit through the lateral faces 26, 27 of the magnetic core 20. Inside the magnetic core 20, the flux lines are bundled with increasing distance from the front sides and are uniformly distributed over the core cross-section.

Figure 3B:
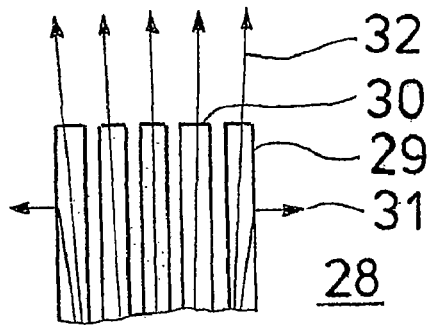
FIG. 3*b* shows the flux course at the edge of a laminated magnetic core.

FIG. 3*b* shows a similar distribution of the flux lines in a magnetic core 28, which is constructed from individual strip-shaped magnetic elements 29, 30. It is shown that the distribution of the flux lines 31, 32 in the outer area of the magnetic core 28 approximately corresponds to the distribution in a solid magnetic core as shown in FIG. 3*a*.

However, upon analysis of the course of the flux lines within the individual magnetic elements 29, 30, it results that because of the partition faces between the individual magnetic elements, the flux has the tendency after entering one of the magnetic elements to run further there, without jumping over partition faces to another magnetic element. This has the result that the flux lines 31, 32 which are separated outside the magnetic core 28 both run in a single magnetic element 29 within the magnetic core 28. This is a problem which occurs above all in the outermost magnetic elements of a magnetic core, and which decreases strongly toward the central magnetic elements in any case. Overload and magnetic saturation of the outer magnetic elements result, which are to be avoided according to an embodiment.

The courses shown in FIGS. 3*a* and 3*b* also apply for annular cores shown in FIG. 2*b*, if only one of the front sides of the annular core is observed.

Figure 4:
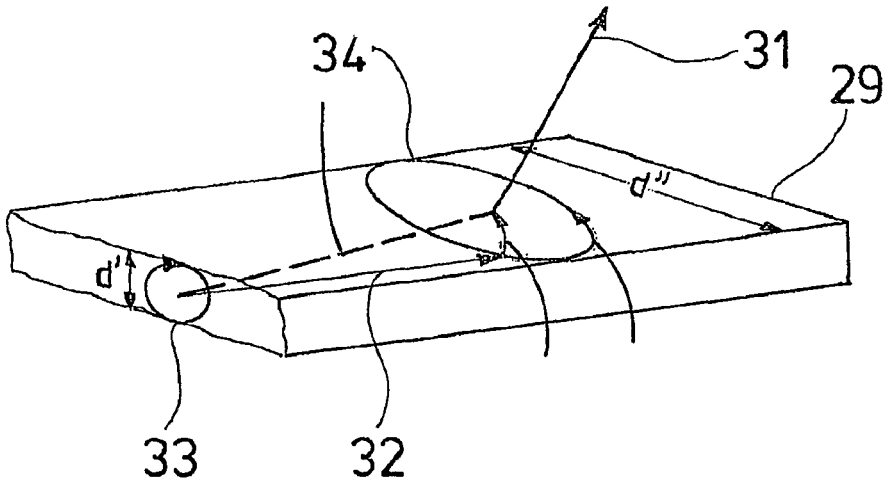
FIG. 4 shows flux lines running in a magnetic element and exiting from the element and corresponding relevant eddy current paths, FIGS. 5*a*, 5*b* each show a laminated core having shortened magnetic elements, FIGS. 6*a*, 6*b* each show a magnetic core having curved magnetic elements.

FIG. 4 is to show to what extent and in which way the flux components 32 running inside and in the longitudinal direction of a magnetic element 29 are more favorable than the components of the flux lines 31, which enter the wall plane diagonally, running diagonally to the strip plane, in particular perpendicular to the strip plane.

The typical eddy current losses occurring due to hysteresis are each caused by the annular flux of electrical current perpendicular to the flux direction in the material. The eddy current paths which are identified by 33, 34 in FIG. 4 have an essentially circular shape and the occurring loss is proportional to the square of the maximal diameter d', d" available for an eddy current path.

As shown in FIG. 4, only a diameter d' of the circuit 33, which corresponds at most to the thickness of the magnetic element 29, is available for corresponding eddy current paths for the flux lines 32 running in the strip plane. Eddy current losses of this type may thus be effectively limited by the selection of thin magnetic elements. Magnetic elements in strip form in thicknesses down to below 10 μm are available here. Thicknesses between 10 and 30 μm are typical.

For components 31 of flux lines which run perpendicular to the strip plane, in contrast, an eddy current path 34 in circular form having a larger diameter d" is available, which may exploit the entire width of the strip conductor 29. Therefore, the eddy current losses of flux components running perpendicular to the strip plane are significantly greater, because of their dependence on the square of d, than for longitudinally-running fluxes 32. Therefore, it has been shown that flux exiting from the strip material causes losses which are larger by orders of magnitude because of the flux components diagonally running in the strip material, which are automatically connected thereto, than the longitudinally-running flux components exiting from the front sides.

Figure 5A:
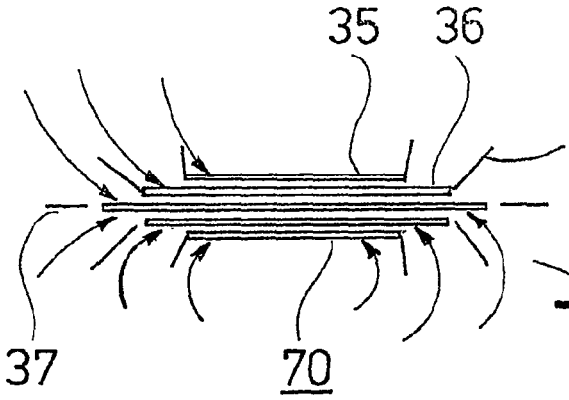

The various measures according to various embodiments have the goal of concentrating the flux inside the magnetic core essentially into these longitudinally-running flux directions and to distribute the flux as uniformly as possible on the individual magnetic elements. For this purpose, FIG. 5*a* shows a magnetic core 70 for a symmetrical dipole field, in which the outer strip layers are shortened in relation to the inner strip layers. Corresponding flux lines entering diagonally into the core therefore do not all run diagonally into the lateral delimitation face of the outermost magnetic element 35, but rather partially also into the second-outermost magnetic element 36, where it projects beyond the outermost magnetic element 35. The same distribution is also shown on the other side of the longitudinal axis 37, so that evening out of the distribution of the flux density on the various magnetic element 35, 36 is thus achieved and in particular—contrary to the prior art shown in FIG. 3*b*—the diagonally incident components are also distributed on the various magnetic elements. Effective distribution of the loss power and thus a lower probability of local overheating of the magnetic core thus also result.

Figure 5B:
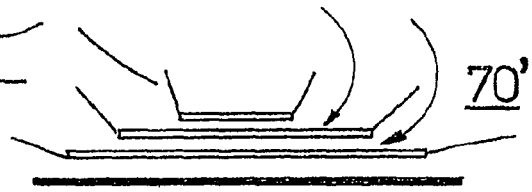

FIG. 5*b* shows a stepped construction having a view of a magnetic core 70' which is trapezoidal in longitudinal section, and which is advisable if the corresponding magnetic core is to be used in an asymmetrical magnetic field. In the example shown, the flux density above the magnetic body is significantly greater than below, for example, because a soft-magnetic further body (not shown), is positioned above the magnetic body.

The length differences between the individual magnetic elements 35, 36 may vary more than 5%, in particular also more than 10% over the entire stack of a magnetic core.

Figure 6A:
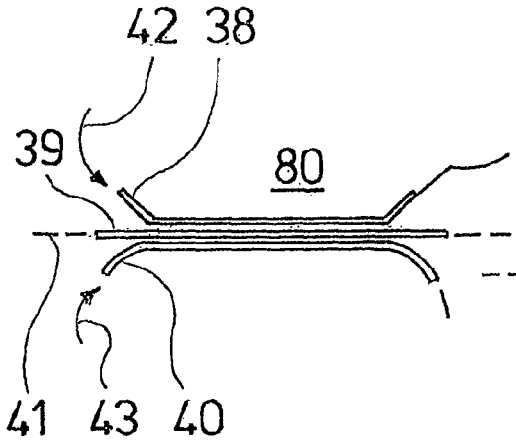

FIG. 6*a* shows a variant in which, in a core 80 of magnetic elements 38, 39, 40, the ends of the magnetic elements are curved away from the longitudinal axis 41. This allows the flux lines 42, 43 preferred entry into the front faces of the magnetic element 38, 40, so that the flux first runs there within the particular magnetic element in its longitudinal direction and eddy current losses are correspondingly kept low. The flux essentially follows the curvature inside the magnetic element, so that the flux lines are also bundled with the magnetic elements which are bundled in the middle.

Figure 6B:
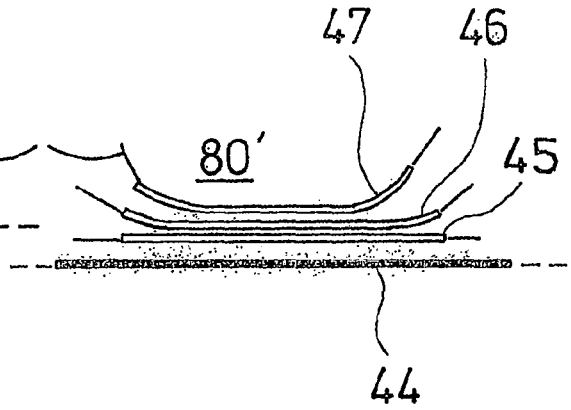

FIG. 6*a* shows a design of this type for a symmetrical flux line course, thus, in FIG. 6*b* an optimized design for an asymmetrical flux line course is shown. For example, the body 44 may be a non-magnetic metal plate, which displaces the magnetic flux, so that the density of the magnetic flux is greater above the magnetic core 80' than below. The lowermost magnetic element 45 may be implemented as linear, the magnetic elements 46, 47 situated above it are each curved away from the longitudinal axis of the magnetic core at their ends, to allow an optimized entry of the flux lines into the magnetic elements.

A further variant of the design according to an embodiment is to be explained in connection with FIG. 1, in which, according to the prior art, geometrically identically-shaped magnetic elements 2 through 8 are layered.

According to an embodiment, these magnetic elements 2 through 8 may also be equipped with varying material permeability, however, either only the outermost, i.e., 2 and 8, being equipped with reduced material permeability, or several of the magnetic elements 2 through 8 being provided with material permeability which sinks from the inside to the outside. The highest material permeability is to be achieved in the central area of the stack, for example, in the magnetic elements 4, 5, and 6. The difference between the permeabilities ($\mu max - \mu min$) is to be at least 10%, preferably more than 100% in relation to the average permeability over the entire core.

Due to this design, the central magnetic elements attract the flux more strongly because of their higher permeability, so that the effect of the laterally incident flux being additionally captured in the external magnetic elements is evened out to some degree. A uniform distribution of the flux on the cross-section of the magnetic core may thus be achieved.

Figure 7A:
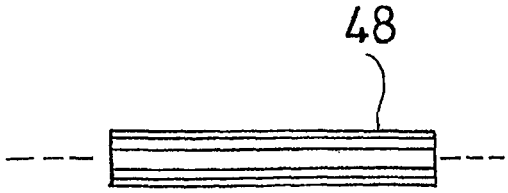
FIG. 7*a* shows a magnetic core having magnetic elements of different thicknesses.

To achieve optimized magnetic properties, FIG. 7*a* shows a magnetic core which comprises magnetic elements of varying thickness, the thickness decreasing from the inside to the outside. The outermost magnetic element 48 is thus thinner than the remaining magnetic elements. In addition to the symmetrical construction of a thickness distribution of this type shown here, an asymmetrical construction analogous to that shown in FIG. 5*b* and FIG. 6*b* may also be provided, of course.

Figure 7B:
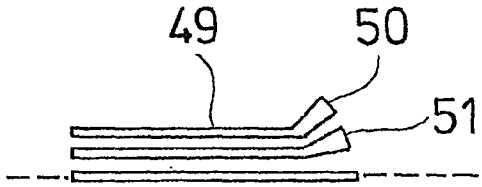
FIG. 7*b* shows a magnetic core having magnetic elements thickened at their ends.

FIG. 7*b* shows a design of a magnetic core in which, at the ends of the magnetic element 49, thickened places 50, 51 are provided at one or both ends of each magnetic element, to make the entry of flux lines easier. Only certain of the magnetic elements may also have corresponding thickened places, specifically those magnetic elements into which the flux is preferably to be deflected, for example, also only the centrally situated magnetic elements.

In addition to the design having thickened ends 50, 51, the magnetic elements may each increase continuously in thickness toward the ends from their middle in relation to the length, and magnetic elements having varying contour are also correspondingly provided in the stack, to even this out in the overall stack and achieve a cuboid magnetic body. The magnetic elements which become thicker toward their ends are preferably situated in the middle of the stack, while the magnetic elements which become thinner toward their ends are to be provided in the outer layers, to achieve uniform flux distribution at lower loss power.

FIG. 8*a* shows a stack of magnetic elements 52, 53 which form a magnetic core 90, notches 54, 55 being provided in the outermost magnetic element 52, which completely penetrate the magnetic element 52 perpendicular to its strip plane. The effective width of the magnetic element 52 for eddy currents of perpendicular flux components (cf. FIG. 4) is limited by these notches, because only the intermediate spaces 56, 57 between the notches 54, 55 are still available for an eddy current path and the diameter of the eddy current paths is thus effectively reduced.

FIG. 8*b* shows a refinement in which the notches completely penetrate the magnetic elements in their longitudinal direction, which results here in a bundle of rod-shaped magnetic elements and/or magnetic elements of lower width, which are situated one on top of another and adjacent to one another.

FIG. 9 shows two measures which may be provided in a configuration according to an embodiment having a magnetic core 58 and a winding 59. Because especially many flux lines exit laterally from the magnetic core at the end of a winding, in particular if it is not coincident with the end of the magnetic core, this area is especially critical for the undesired flux components perpendicular to the lateral faces of the magnetic core. Therefore, on one hand, the winding may be led beyond the end of the magnetic core, as is the case at the upper end of the coil 59 shown. This may be performed, for example, in that the magnetic core is enclosed by a sleeve, onto which the winding is wound and which projects beyond the magnetic core at both ends or at one end.

At the lower end of the configuration shown in FIG. 9, the winding 59 is strongly gathered, i.e., the turn density per unit of length in the longitudinal direction of the magnetic core is strongly increased there. An increase by at least 10% of the turn density is advantageous. The winding ends at this lower end at the front side of the magnetic core. The flux lines running in the magnetic core are especially effectively bundled by the gathering of the winding, so that the exiting of diagonal field components at the edges of the front face of the magnetic core is reduced. FIG. 9 is to be understood as an example and it is obvious that both measures, gathering the winding and projecting the winding beyond the ends of the magnetic core, may each also be applied at both ends of the magnetic core and combined with one another. Moreover, these two measures may also be advantageous independently of the measures according to an embodiment.

FIG. 10*a* shows a base plate 60 which comprises aluminum or another metal, for example, which is non-magnetic and displaces the magnetic field lines. A magnetic core 61, which comprises strip-shaped magnetic elements, which rest flat on the plate 60 and/or are situated above the plate and parallel thereto, may be situated with or without spacing to this plate. According to the laws of magnetism, the magnetic flux will rather close on the side of the magnetic core 61 facing away from the plate 60, i.e., the majority of the flux lines 62, 63 will exit in the arc out of the magnetic core 61, specifically out of the plane of the drawing and upward. This automatically results in the increased exiting of flux components perpendicular to the plane of the strip-shaped magnetic elements, which is connected to an increased flux density in the uppermost magnetic elements and an increase of the eddy current losses therein.

Therefore, according to an embodiment, in such a configuration according to FIG. 10*b*, in this geometric constellation, the strip planes of the magnetic elements may be perpendicular to the plate 60, so that the diagonally exiting flux lines 64, 65 do not form any components perpendicular to the strip plane, but rather only components in the strip plane, whose eddy current losses may be limited by the lower thickness of the individual magnetic elements (compare above explanations of FIG. 4). This measure may also be combined with the remaining measures described on the basis of the exemplary embodiments.

In the design shown in FIG. 10*b*, the stack height, i.e., the dimension of the magnetic core perpendicular to the planes of the strip-shaped magnetic elements, may be greater than the width of the stack, i.e., the dimensions of the core perpendicular to this direction in the direction of the width of the individual magnetic elements.

In the following, several measurement results from several measurements and from the literature for three model antennas are described, whose cores comprised 30 layers of MgO-insulated strips (on average 15 cm long, 12.5 mm wide, 20 μm thick) made of amorphous cobalt-based material ($\mu_i$ approximately 2000). The turn count of the winding was around 60, the attempt being made to maintain an inductance of approximately 110 μH at 100 kHz. A reference antenna comprises rectangular identical strips according to the described prior art. With asymmetrically oriented flux guiding between transmission and reception antennas, favored by the cores themselves and by shielding and flux conduction parts, the reference configuration was selected corresponding to the prior art in such a way that the flux was preferably guided out of the face of the strips. The antennas according to various embodiments were constructed as identically as possible in comparison except for the particular described modifications. As the transmission antenna, the antennas were driven in such a way that at 100 kHz, a spatially averaged control range of $\hat{B}$=100 mT, i.e., a flux of approximately 0.75 μWb, was generated. In each case, the quality of the antenna and the power consumption are specified, the first being maximized and the latter being minimized. As the reception antenna, the antennas were brought into the field of a transmission antenna and the induced voltage was measured. The field was generated by a reference antenna, the flux therein was $\hat{\Phi}$=1 μWb at 100 kHz. Both antennas were operated adjacent to one another, parallel to one another, and centered having a spacing of 20 cm of both axes. When sheet aluminum was used as shielding, it was located on the side facing away from the transmission antenna.

| Embodiment | Q | P [mW] | $U_{ind}$ [mV/Wdg.] |
|---|---|---|---|
| Prior art: identical strips stacked flatly one on top of another; homogeneous winding over entire length | 34 | 213 | 1.4 |
| Identical, antennas lie at 5 mm spacing (measured from core middle) on large-area sheet aluminum | 35 | 227 | 1.5 |
| Three centered partial stacks lying one on top of another, inner partial stack being lengthened by 14% in relation to the reference, the two outer partial stacks being shortened by 7% | 40 | 169 | 1.7 |
| Strip layers continuously shortened from the center outward, the inner strip layers being lengthened by 10% in relation to the reference, the outer strip layers being shortened by 10% | 42 | 155 | 1.8 |
| Counterexample: three centered packets stacked one on top of another, an outer partial stack being lengthened by 10% in relation to the reference, the other outer partial stack being shortened by 10%. Antennas lie at 5 mm spacing on sheet aluminum, with the shorter strip packet toward the sheet. | 30 | 233 | 1.7 |
| Identical, according to various embodiments having the longer strip packet lying toward the sheet | 38 | 183 | 1.7 |
| Three geometrically identical partial stacks lying one on top of another, inner partial stack having a starting permeability higher by a factor of 5 than the outer layers (=reference) | 34 | 210 | 1.8 |
| Two equally long partial stacks lying one on top of another, homogeneous winding shortened, so that the core projects 1 cm beyond the winding end at both ends, the last 8 mm of each partial stack are bent outward by 60-90° | 39 | 178 | 1.6 |
| Strips stacked flatly one on top of another like reference; homogeneous winding over entire length; however, all strips notched in three equally wide tracks 2 cm from both ends | 37 | 180 | 1.4 |
| Identical, but only the uppermost and lowermost 5 strips are notched in the way described above | 36 | 187 | 1.4 |

As an example for the prior art, an antenna was constructed from 200 layers of cobalt-amorphous strip having $\mu_i$=1800 and a thickness of 22 μm (a stack height of approximately 6 mm thus results in consideration of a thin insulation layer and a typical strip fill factor of 80%), width 12.5 mm, length 300 μm. The core was provided with a homogeneous winding N=20 and mounted at a spacing of 10 mm—measured from the core surface out—on a large-area aluminum sheet, the strip planes lying parallel to the sheet plane. Therefore, the magnetic field preferably radiates away from the plate, connected with an increased flux exit from the strip faces. Upon sinusoidal driving at 70 kHz and a mean control range of 100 mT, a power consumption of 4.5 W and an antenna quality of 35 were measured. The power consumption is a measure of the hysteresis losses in this case.

The effective strip width was reduced by notching the strips. This is especially effective in the areas in which flux components are active perpendicular to the strip surface, i.e., at the ends of the outer strip layers. For reasons of efficient manufacturing, however, all strips may be divided at the ends or continuously, the effect increasing with the number of cuts. As an example of this, the ends (3 cm) of the antennas cited under example 1 according to the prior art were cut in thirds along the strip axes. The power consumption sank to 3.8 W, the quality rose to 38.

What is claimed is:

1. A magnetic core made of metallic alloy having a linear or curved longitudinal axis, parallel to which a magnetic flux is to be guided essentially inside the magnetic core, the magnetic core being assembled from multiple rod-shaped or strip-shaped magnetic elements implemented parallel to one another, wherein at least one of the magnetic elements differs from the others in one or more of the following features:

material permeability, curvature, length, shape and/or size of the cross-sectional area, presence, type, and position of notches in the magnetic elements, and wherein, viewed along a transverse direction extending through the thickness of the magnetic core and perpendicular to the longitudinal axis of the magnetic core, the magnetic elements have, with increasing distance from the center of thickness of the magnetic core outward towards a side of the magnetic core:

a decreasing material permeability and/or a decreasing length and/or an increasing curvature away from the longitudinal axis and/or a thickness which becomes smaller and/or an increasing number and/or growing depth of notches.

2. The magnetic core according to claim 1, wherein multiple of the magnetic elements differ from other magnetic elements in regard to one of the features as a function of their position within the magnetic core.

3. The magnetic core according to claim 1, wherein the multiple magnetic elements are symmetrically distributed among the other magnetic elements in regard to the cross-section of the magnetic core in relation to a central axis or a central plane.

4. The magnetic core according to claim 1, wherein the magnetic elements laid on one or more lateral faces of the magnetic core differ from the other magnetic elements in regard to at least one of the features.

5. The magnetic core according to claim 4, wherein a continuous or step-by-step transition in regard to the extent of the differences in relation to one of the features is provided between the magnetic elements laid on the lateral faces of the magnetic core and the longitudinal axis of the magnetic core.

6. The magnetic core according to claim 1, wherein the magnetic elements laid directly on a lateral face of the magnetic core are curved away at their ends from the longitudinal axis of the magnetic core.

7. The magnetic core according to claim 1, wherein the magnetic elements are implemented as strip-shaped, and at least the outer magnetic elements of the magnetic core have one or more notches, which run parallel to one another and completely penetrate the particular magnetic element, and which extend from the end of the particular magnetic element therein and divide it in width.

8. The magnetic core according to claim 1, wherein the magnetic elements comprise a soft-magnetic material, in particular a nanocrystalline material or a glass-like magnetic material produced by rapid solidification technology.

9. The magnetic core according to claim 1, wherein some of the magnetic elements have an enlarged cross-sectional area toward their ends, and in particular others of the magnetic elements have a reduced cross-sectional area toward their ends.

10. The magnetic core according to claim 9, wherein those magnetic elements which have enlarged cross-sectional areas toward their ends are situated in the center of the magnetic core, while magnetic elements having a cross-sectional area remaining uniform over their length or decreasing toward the ends are situated on the exterior sides of the magnetic core.

11. A configuration having a magnetic core according to claim 1, wherein the configuration further comprises an electrically conductive winding enclosing the magnetic core, wherein the turn density increases toward at least one of the ends of the magnetic core.

12. A configuration having a magnetic core according to claim 1, wherein the configuration further comprises an electrically conductive winding enclosing the magnetic core, wherein the winding extends axially beyond its end on at least one end of the magnetic core.

13. A configuration having a magnetic core according to claim 1, wherein the configuration further comprises an electrically conductive winding enclosing the magnetic core, wherein the turn density increases toward at least one end of the magnetic core and the winding extends axially beyond its end on at least one end of the magnetic core.

14. A configuration having a magnetic core according to claim 1, comprising an additional magnetically active body, due to whose presence the magnetic flux enters and/or exits the magnetic core asymmetrically.

15. The configuration according to claim 14, wherein the body is an electrically conductive body.

16. The configuration according to claim 14, wherein the body comprises a material having a magnetic permeability >1.

17. The configuration according to claim 14, wherein the magnetic core is implemented and situated in such a way that the magnetic flux predominantly exits at edges of the magnetic elements.

* * * * *